US011008129B2

(12) United States Patent
Pierre et al.

(10) Patent No.: US 11,008,129 B2
(45) Date of Patent: May 18, 2021

(54) PETALOID BASE WITH BROKEN VALLEY

(71) Applicant: SIDEL PARTICIPATIONS, Octeville-sur-Mer (FR)

(72) Inventors: Ivan Pierre, Octeville-sur-mer (FR); Laurent Naveau, Octeville-sur-mer (FR)

(73) Assignee: SIDEL PARTICIPATIONS

( * ) Notice: Subject to any disclaimer, the term of this patent is extended or adjusted under 35 U.S.C. 154(b) by 87 days.

(21) Appl. No.: 16/340,345

(22) PCT Filed: Sep. 21, 2017

(86) PCT No.: PCT/FR2017/052530

§ 371 (c)(1),
(2) Date: Apr. 8, 2019

(87) PCT Pub. No.: WO2018/065691

PCT Pub. Date: Apr. 12, 2018

(65) Prior Publication Data

US 2019/0308764 A1 Oct. 10, 2019

(30) Foreign Application Priority Data

Oct. 6, 2016 (FR) ..... 1659634

(51) Int. Cl.
*B65D 1/02* (2006.01)

(52) U.S. Cl.
CPC ..... *B65D 1/0284* (2013.01)

(58) Field of Classification Search
CPC .. B65D 1/0284; B65D 1/0261; B65D 1/0223; B29C 49/06
See application file for complete search history.

(56) References Cited

U.S. PATENT DOCUMENTS

| | | | |
|---|---|---|---|
| 5,484,072 | A | 1/1996 | Beck et al. |
| 7,051,889 | B2 | 5/2006 | Boukobza |
| 10,202,221 | B2 | 2/2019 | Boukobza |

(Continued)

FOREIGN PATENT DOCUMENTS

| | | | |
|---|---|---|---|
| EP | 0671331 | A1 | 9/1995 |
| FR | 2822804 | A1 | 10/2002 |

(Continued)

OTHER PUBLICATIONS

International Search Report, dated Feb. 15, 2018, from corresponding PCT application No. PCT/FR2017/052530.

*Primary Examiner* — Shawn M Braden

(57) ABSTRACT

Disclosed is a container provided with a petaloid base having feet that form protrusions towards the outside of the container, separated two by two by recessed valleys that extend radially from a central dome of the base to a periphery of same, each foot having a median face with concavity facing outwards and extending via an end face forming a discontinuous seat ring, with a planar cross section, each valley having an inner portion extending from the central dome and an outer portion that meets the periphery, the inner portion and the outer portion being, in cross section in a central radial plane at the valley, straight and together forming an obtuse angle protruding towards the outside of the container and meeting at a vertex situated in line with or very nearly in line with the seat ring.

17 Claims, 5 Drawing Sheets

(56) References Cited

U.S. PATENT DOCUMENTS

| | | | | |
|---|---|---|---|---|
| 2014/0175043 | A1 | 6/2014 | Haner et al. | |
| 2014/0183156 | A1* | 7/2014 | Hanan | B65D 1/0284 215/382 |
| 2016/0144992 | A1 | 5/2016 | Hermel | |
| 2016/0229579 | A1* | 8/2016 | Pierre | B65D 1/0284 |
| 2017/0121049 | A1* | 5/2017 | Bouquin | B65D 1/0246 |
| 2017/0144817 | A1* | 5/2017 | Godet | B65D 1/0207 |
| 2020/0255178 | A1* | 8/2020 | Hanan | B65D 1/0284 |

FOREIGN PATENT DOCUMENTS

| | | | | |
|---|---|---|---|---|
| WO | 2012/069759 | A1 | 5/2012 | |
| WO | 2014/207331 | A1 | 12/2014 | |
| WO | WO-2015071565 | A1 * | 5/2015 | B65D 1/0284 |

* cited by examiner

FIG.1
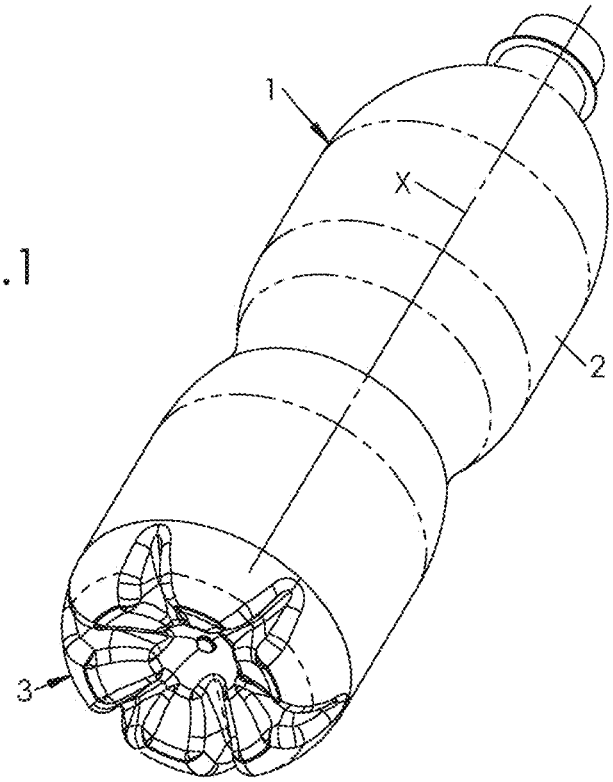
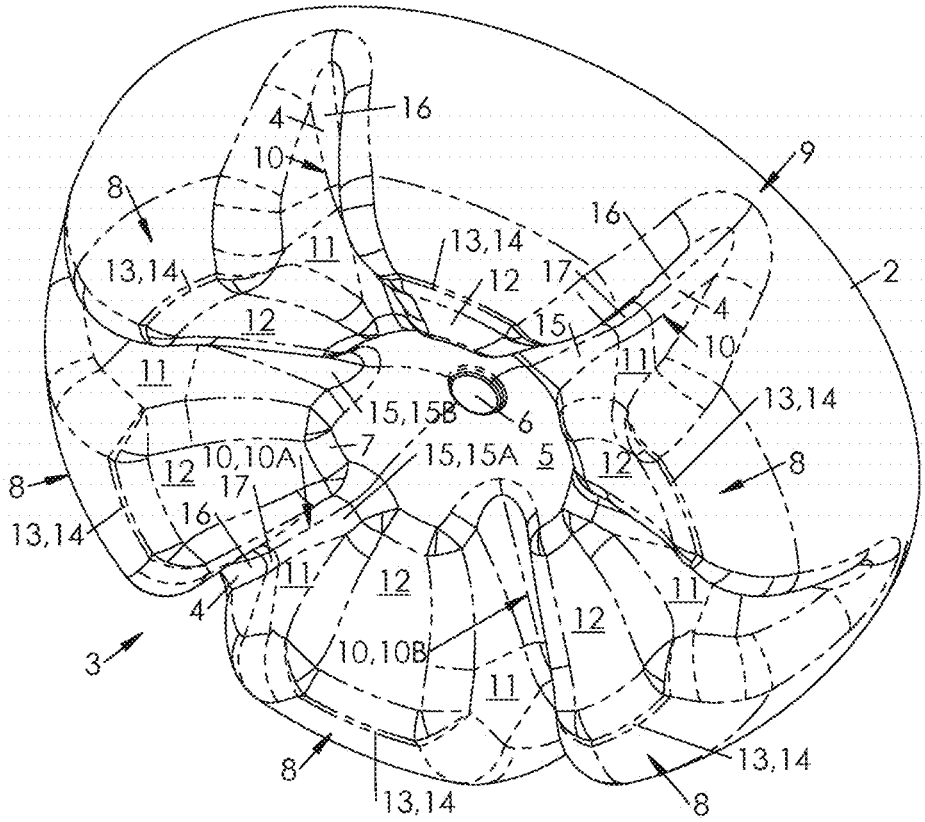
FIG.2

FIG.3
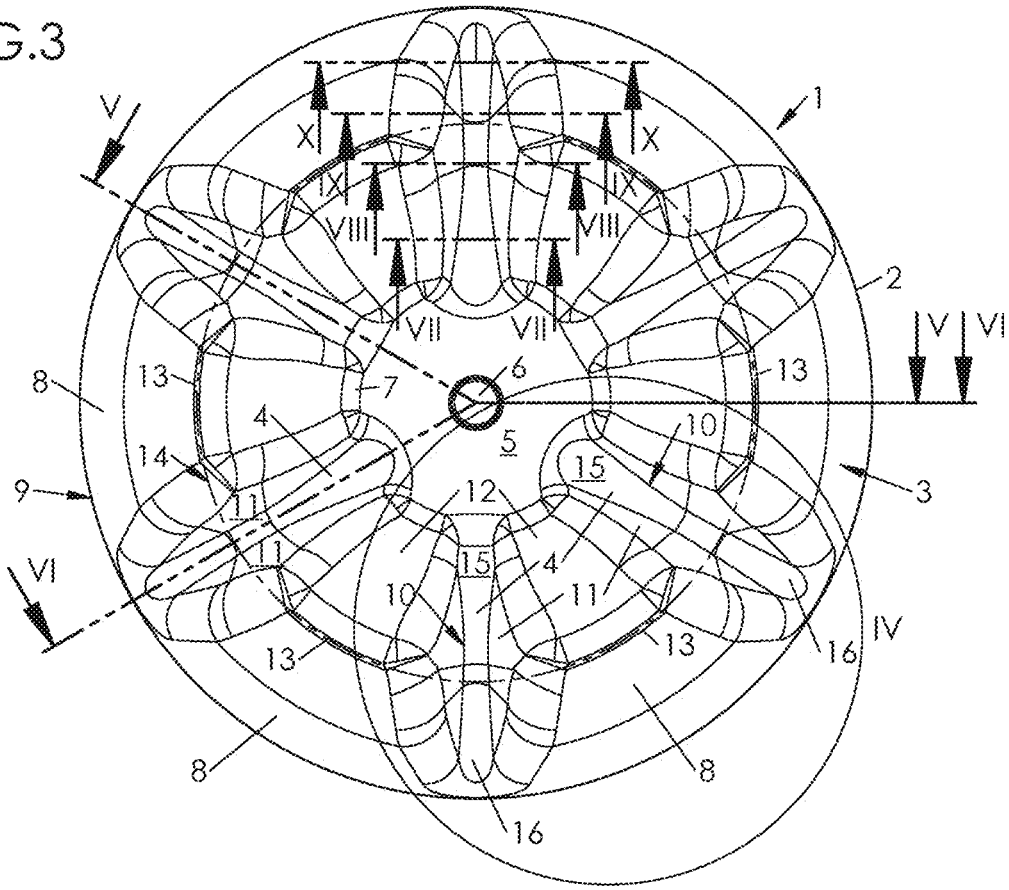
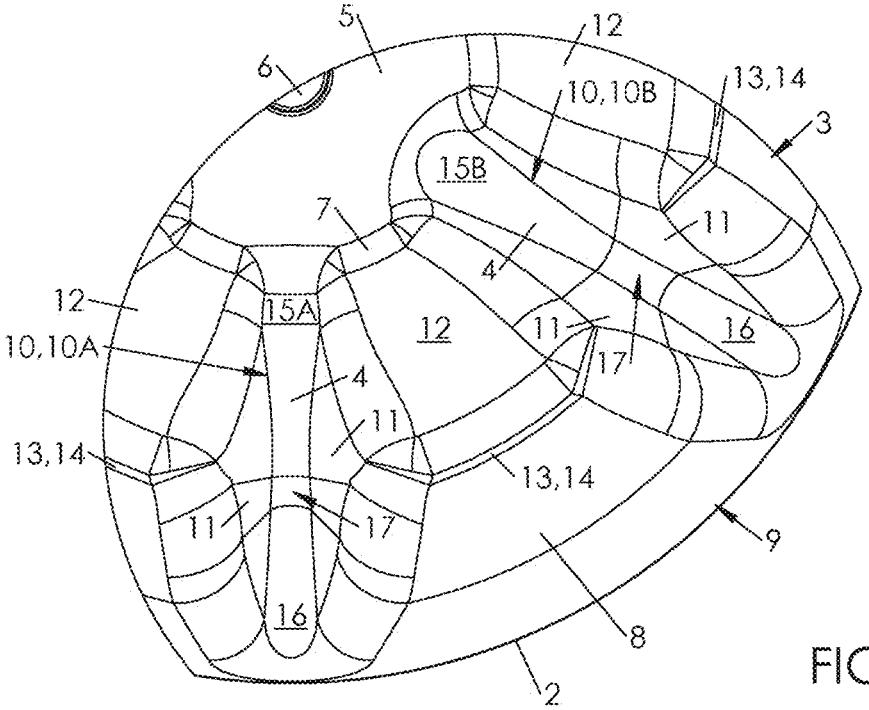
FIG.4

PETALOID BASE WITH BROKEN VALLEY

The invention relates to the field of containers, in particular bottles or pots, manufactured by blow molding or stretch blow molding from blanks (preforms or intermediate containers) made of plastic material such as polyethylene terephthalate (PET).

A container generally comprises an open neck, through which the contents (ordinarily a liquid) are introduced, a body that imparts to the container its volume, and a bottom, which closes the body opposite the neck and forms a base that is intended to ensure the stability and the holding of the container when it rests on a surface.

The containers that are intended for carbonated beverages, in which the pressure of the gas dissolved in the liquid creates significant mechanical stresses, are for the most part provided with petal-shaped bottoms of great height, known under the name "petaloid bottoms." Such bottoms comprise protruding feet, in the shape of petals, separated by convex wall portions, called recesses or valleys, which extend radially from a central zone of the bottom. The feet, of great height (i.e., in a ratio of approximately ½ with the diameter of the container), are intended to ensure the holding of the container that is placed on a surface; the valleys are intended to absorb the forces (thermal, mechanical) that are exerted by the contents. An illustrative example of this type of bottom will be found in the international application WO 2012/069759 (Sidel Participations).

The petaloid bottoms appear as a relatively successful approach making possible good resistance to the strong internal pressures of the containers (in particular thanks to the hemispherical shape of the valleys) that are provided therewith.

However, a petaloid bottom requires a large quantity of material (a 0.5 l container with a conventional petaloid bottom, having a weight that is greater than or equal to approximately 18 g), as well as a relatively high blow-molding pressure (on the order of 22 to 30 bar), to ensure a correct impression-taking of the feet and valleys in the manufacturing mold.

These stresses tend to disqualify the petaloid bottoms for the "flat-liquids"-type applications (typically table water or non-fizzy beverages) for which both the blow-molding pressure and the quantity of material used (today on the order of 10 g at the very most for a 0.5 l container) are reduced.

It becomes common practice, for certain applications of flat liquids that are sensitive to oxidation (in particular fruit juices), but also certain still waters, to replace the air by superimposing such flat liquids with an inert gas (typically nitrogen). In practice, this operation is carried out by depositing a drop of liquefied inert gas on the surface of flat liquids, just before the container is stoppered. This operation creates an overpressure in the containers to which this treatment is applied. Even though it appears slight (on the order of 0.5 to 1.3 bar), this overpressure is enough to increase significantly the stresses that are exerted on the bottoms, without these stresses justifying, however, recourse to conventional petaloid bottoms (i.e., of great height).

Yet, a bottom that is provided with a simple concave arch, if it meets a priori material savings requirements and makes it easy to manufacture containers by blow molding (containers are said to have easy "blowability"), is nevertheless not able to withstand—without significant deformation—the stresses that arise from the doubled hydrostatic pressure of the added inert gas pressure.

There is therefore a need for a container whose bottom offers an increased resistance to the internal stresses in relation to the ordinary arched bottoms, while not requiring as much material, nor as high a blow-molding pressure, as an ordinary petaloid bottom.

There has therefore been proposed, cf. the international application WO2014207331 (Sidel Participations), a petaloid bottom of low height, whose ratio h/d between the height (h) of the feet and the overall diameter (d) of the bottom is less than or equal to ⅕, with this bottom also being provided with a central dome and grooves straddling the valleys and on the dome.

This bottom has advantageous mechanical performances, which make it suitable for the addition of a pressurized inert gas, provided that, however, the quantity of material used for the manufacturing of the container is adequate.

Yet, manufacturers are demanding ever greater material savings, and there is again a need to propose a new container whose bottom can, with a still reduced quantity of material, offer adequate mechanical strength under pressure while having easy blowability.

Proposed for this purpose is a container made of plastic material comprising a body, which extends along a main axis, and a petaloid bottom, which extends the body, with this bottom comprising:

- A bottom wall of general convex shape toward the exterior of the container,
- A central dome formed recessed toward the interior of the container and that extends from a central vertex to a peripheral edge by which the dome connects to the bottom wall, and
- At least four feet that form protrusions from the bottom wall toward the exterior of the container, separated two by two by bottom wall portions forming at least four recessed valleys that extend radially from a central dome of the bottom to a periphery of the latter, with each foot having two sides, each bordering a valley, and a central face that, in a radial plane, has a curved profile with concavity facing the exterior of the container and extends via an end face, with the end faces jointly forming a seat ring, with a planar cross-section, while being discontinuous at right angles with each valley, container in which:

- Each valley has an inner portion that extends from the central dome and an outer portion that abuts the periphery in the extension of the inner portion, with the inner portion and the outer portion being, in cross-section in a central radial plane in the valley, straight and forming together an obtuse angle protruding toward the exterior of the container and meeting at a vertex situated in line with or very nearly in line with the seat ring;
- The bottom comprises two groups of valleys placed alternately:
  - Primary valleys whose inner portion connects to the dome at the height of the peripheral edge of the latter;
  - Secondary valleys whose inner portion connects to the dome between the peripheral edge and the central vertex of the dome, at a distance from the peripheral edge.

This structure produces at the bottom good mechanical rigidity, including when the container is pressurized, while having good blowability.

Various additional characteristics can be provided, by themselves or in combination.

The dome has a height, measured axially between its peripheral edge and its vertex, and, in the secondary valleys, the inner portion advantageously connects to the dome at a distance from the peripheral edge of between 20% and 70% of said height of the dome.

In the secondary valleys, the inner portion is preferably inclined, in relation to any plane that is parallel to the plane of the seat ring, toward the interior of the container, by an angle that is advantageously between 5° and 30°.

In the primary valleys, the inner portion is preferably inclined, in relation to any plane that is parallel to the plane of the seat ring, toward the exterior of the container, by an angle that is advantageously between 2° and 10°.

As a variant, in the primary valleys, the inner portion is inclined, in relation to any plane that is parallel to the plane of the seat ring, toward the interior of the container by an angle that is less than or equal to 4°.

In the central radial plane in each valley, the vertex of the valley can be offset in relation to the seat ring, for example by a value of between 1.5 mm and 3 mm.

The obtuse angle that is formed, in the central radial plane with a primary valley, between the inner portion and the outer portion, has a value that is preferably between 130° and 175°, and, for example, a value of approximately 160°.

The obtuse angle that is formed, in the central radial plane with a secondary valley, between the inner portion and the outer portion, has a value of between 130° and 165°, and advantageously from approximately 140° to 145°.

The vertex of each valley is advantageously distant from the plane of the seat ring by a value of between 10% and 15%—and, for example, approximately 12%—of the overall diameter of the bottom of the container.

The bottom has an overall diameter, all of the outer portions abut the periphery on the same junction plane, and the feet have a height, measured axially between the plane of the seat ring and said junction plane, whose value is between 15% and 25%, and preferably approximately 20%, of the overall diameter of the bottom.

Other objects and advantages of the invention will emerge from reading the description of an embodiment, given below with reference to the accompanying drawings in which:

FIG. 1 is a bottom perspective view of a container that is equipped with a petaloid bottom of low height;

FIG. 2 is a bottom perspective view of the bottom of FIG. 1, on a larger scale;

FIG. 3 is a bottom plan view of the bottom of the container of FIG. 2;

FIG. 4 is a detail bottom plan view, on a larger scale, of the bottom of FIG. 3 taken in the inset IV;

FIG. 1 shows, in bottom perspective, a container 1—in this case a bottle—obtained by blow molding or stretch blow molding from a blank, such as a preform made of preheated thermoplastic material, for example polyethylene terephthalate (PET).

Figure 5:
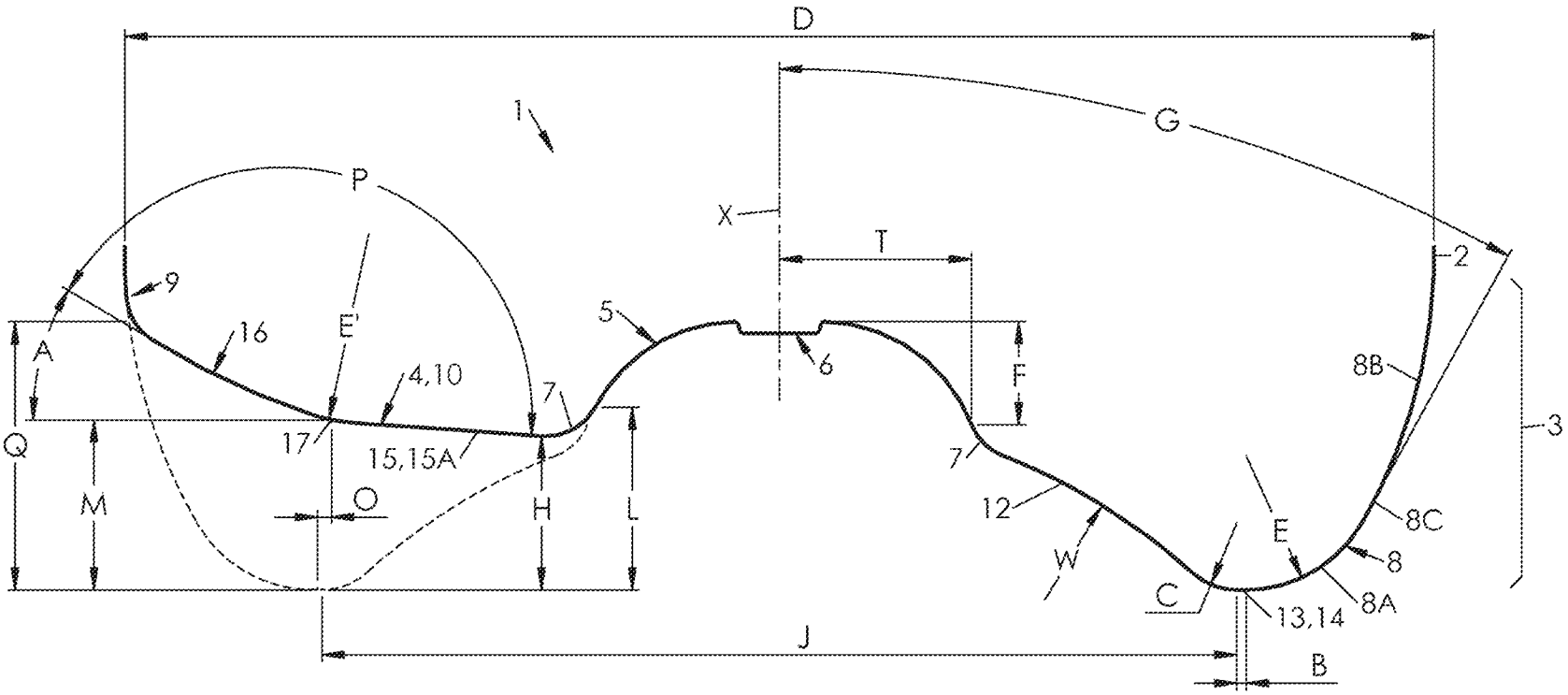
FIG. 5 is a cross-section of the bottom of FIG. 3, along the cutting plane V-V.

The container 1 extends along a main axis X and comprises a side wall called the body 2 and a bottom 3 that extends and closes the body 2 at a lower end of the latter.

The bottom 3 is petaloid and comprises a bottom wall 4 that is of general convex shape toward the exterior of the container 1 (i.e., downward when the container 1 is positioned on a flat surface).

The bottom 3 has a central dome 5 that extends recessed toward the interior of the container 1 (i.e., the dome 5 has a concavity facing the exterior of the container 1). At its center, the dome 5 has a vertex 6. In the illustrated example, the vertex 6 supports, in axial protrusion, a just-injected pellet whose material has remained essentially amorphous during the shaping of the container 1. The dome 5 has in particular as its function to stretch the material in the center of the bottom, so as to increase its crystallinity and thus the mechanical strength.

The dome 5 extends to a peripheral edge 7 (here, of essentially circular contour when seen from below) by which it is connected to the bottom wall 4. More specifically, the peripheral edge 7 forms a connecting fillet from the dome 5 to the bottom wall 4.

The bottom 3 further comprises a series of feet 8 that form protrusions in axial projection from the bottom wall 4 to the exterior of the container 1.

The feet 8 extend radially from the central dome 5 (and more specifically from its peripheral edge 7) to a periphery 9 of the bottom 3 where the latter is connected to the body 2.

As is readily seen in FIG. 2 and FIG. 3, the feet 8 are separated two by two by portions of the bottom wall 4 forming valleys 10 that extend radially in the shape of a star from the dome 5 to the periphery 9.

The valleys 10 extend recessed between the feet 8 that they separate two by two. The valleys 10 are essentially straight when seen in a plane that is perpendicular to the main axis X (i.e., in the plane of FIG. 3).

Furthermore, as FIG. 3 also shows, the valleys 10 are advantageously slightly curved and have a width (measured perpendicularly to the radius) that, from the dome 5 to the periphery 9, will initially decrease and then increase.

As FIG. 2 and FIG. 3 clearly show, the feet 8 are equal in number to the valleys 10. In the illustrated example, the bottom 3 comprises six feet 8 and six valleys 10, uniformly alternating and distributed in the shape of a star. This number constitutes a good compromise; it could, however, be lower (but greater than or equal to 4), or higher (but preferably less than or equal to 10).

Each foot 8 has two essentially planar sides 11 that each laterally border a valley 10. As FIG. 7 to FIG. 10 show, the sides 11 are not vertical (because the bottom 3 would then be difficult and even impossible to blow mold), but inclined by opening from the valley 10 to the exterior.

Each foot 8 also has a central face 12 that links up between the sides 11. As illustrated in FIG. 3, seen in a plane that is perpendicular to the main axis X, the central face 12 extends essentially radially.

Furthermore, as illustrated in FIG. 5, in a radial plane, the central face 12 has a curved profile with concavity facing the exterior of the container 1.

The most protruding part of each foot 8, extending the central face 12, forms an end face 13 of the foot 8. The end faces 13 of the feet 8 are co-planar and jointly form a seat ring 14, discontinuous and with a planar cross-section, by which the container 1 can rest on a planar surface (for example a table).

The seat ring 14 is connected to the body 2 by means of a structure having a connecting fillet comprising two parts 8A and 8B, connected at a junction 8C. Said structure will be described in more detail below.

As FIG. 3 shows, the seat ring 14 (indicated in this figure by a circle in broken lines) is situated radially recessed in relation to the periphery 9.

As is readily seen in FIG. 2 and FIG. 3, the feet 8 will taper from the interior to the exterior of the container 1 (i.e., downward) and expand from the central dome 5 to the periphery 9.

Each valley 10 has an inner portion 15 that extends from the central dome 5, and an outer portion 16 that abuts the periphery 9.

All of the outer portions 16 abut the periphery 9 in the same area, therefore on the same cross-section or the same plane that is called the junction plane. The overall height of the bottom 3 is defined as being the distance, measured axially, between the plane of the seat ring 14 (in other words, the end face 13) and the junction plane between the outer portions 16 and the periphery 9. As will be indicated later, this height is referenced Q.

Figure 6:
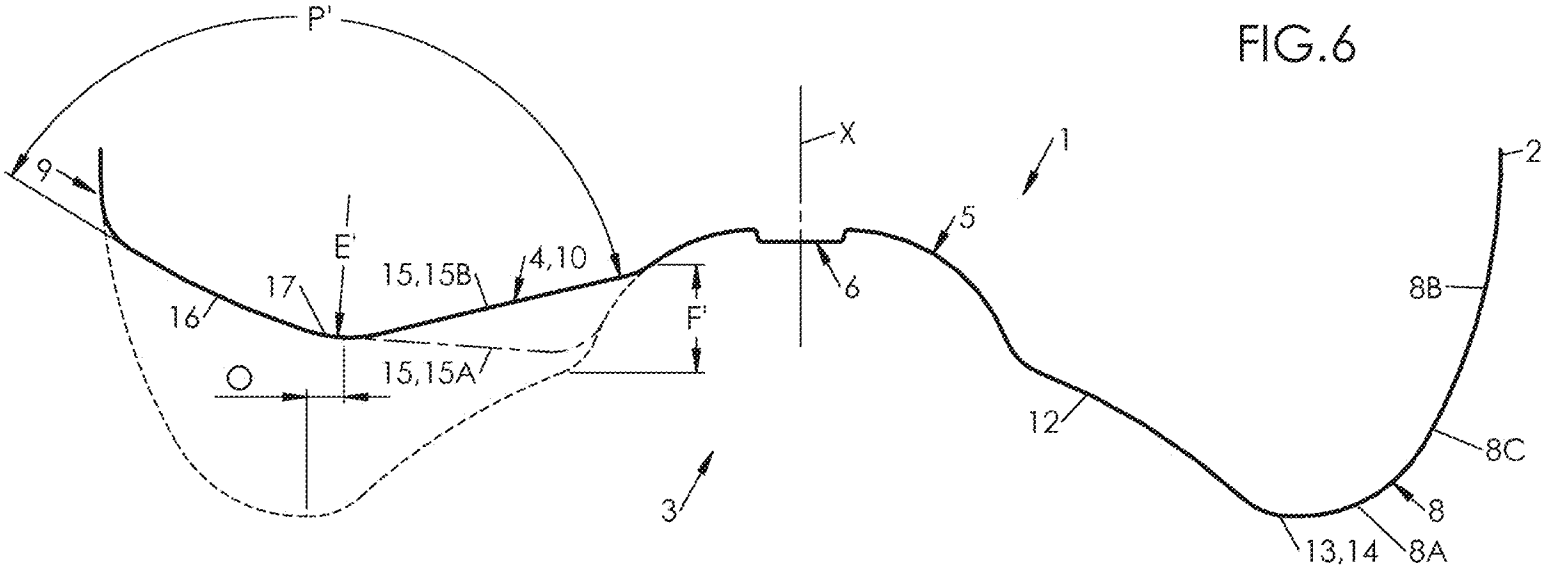
FIG. 6 is a cross-section of the bottom of FIG. 3, along the cutting plane VI-VI.

As illustrated in FIG. 5 and FIG. 6, the inner portion 15 and the outer portion 16 are, in cross-section in a central radial plane in the valley 10, straight and together form an obtuse angle protruding toward the exterior of the container 1.

The inner portion 15 and the outer portion 16 meet at a vertex 17 that is located in line with or very nearly in line with the seat ring 14, i.e., the vertex can be offset from the placement plane determined by the ring 14. According to a preferred embodiment, the vertex 17 is curved in any radial plane and has a concavity facing the interior of the container 1.

It was noted that this shape increases the mechanical strength of the bottom 3, in particular when the container 1 is pressurized.

Furthermore, as illustrated in the drawings (and more particularly in FIG. 5 and in FIG. 6), the valleys 10 are subdivided into two groups of valleys 10 arranged alternately, namely:

- Primary valleys 10A whose inner portion, denoted 15A, connects to the dome 5 at the height of the peripheral edge 7 of the latter;
- Secondary valleys 10B whose inner portion, denoted 15B, connects to the dome 5 at a distance from its peripheral edge 7.

In other words, the inner portion 15B of the secondary valleys 10B is deeper, when measured axially, than the inner portion 15A of the primary valleys 10A. This difference in depth appears in an obvious way in FIG. 2 and on the left in FIG. 6, where the primary valleys 10A are shown in dotted fine lines while the secondary valleys 10B are shown in solid bold lines.

Figure 7:
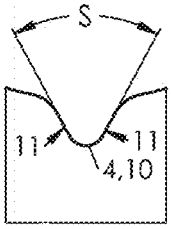
FIG. 7 is a partial cross-section of the bottom of FIG. 3, along the cutting plane VII-VII.
Figure 8:
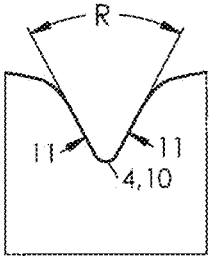
FIG. 8 is a partial cross-section of the bottom of FIG. 3, along the cutting plane VIII-VIII.
Figure 9:
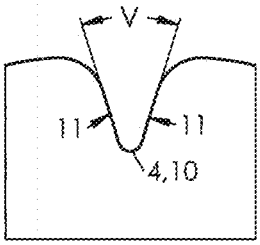
FIG. 9 is a partial cross-section of the bottom of FIG. 3, along the cutting plane IX-IX.
Figure 10:
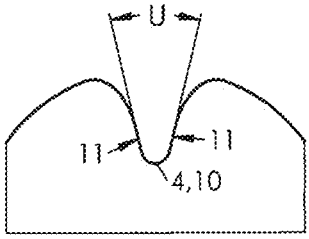
FIG. 10 is a partial cross-section of the bottom of FIG. 3, along the cutting plane X-X.

Additional specifications are now provided regarding the sizing of the bottom 3. For this purpose:

- A denotes the angle, measured in a central radial plane in the valley 10, between the outer portion 16 of the valley and any plane that is perpendicular to the main axis X
- B denotes the width, measured radially, of the seat ring 14
- C denotes the radius of curvature, measured in a radial plane, of a connecting fillet between the central face 12 of the foot 8 and the seat ring 14
- D denotes the overall diameter of the bottom 3, measured at the periphery 9
- E denotes the radius of curvature, measured in a radial plane, of a first part 8A of the connecting fillet between the seat ring 14 and the body 2, with said first part 8A being between the seat ring 14 and the junction 8C between the parts 8A and 8B of the connecting fillet
- E' denotes the radius of curvature of the vertex 17
- F denotes the height of the dome 5, measured axially between the peripheral edge 7 and the vertex 6
- F' denotes the distance, measured axially, between the peripheral edge 7 of the dome 5 and the inside edge of the inner portion 15B of each secondary valley 10B, at its junction with the dome 5
- G denotes the angle, considered in a radial plane, between the axis X of the body 2 and the tangent to the first part 8A of the connecting fillet, at the junction 8C between the parts 8A and 8B of this connecting fillet
- H denotes the distance, measured axially, between, on the one hand, an outer limit of the peripheral edge 7 of the dome 5 and the plane of the seat ring 14
- J denotes the diameter of the seat ring 14, measured on an inner edge of the latter
- L denotes the distance, measured axially, between an inner boundary of the peripheral edge 7 of the dome 5 and the plane of the seat ring 14
- M denotes the distance, measured axially, between the vertex 17 of each valley 10 and the plane of the seat ring 14
- O denotes the offset, measured radially, between the vertex 17 of each valley 10 and the seat ring 14
- P denotes the obtuse angle that is formed, in the central radial plane in each primary valley 10A, between the inner portion 15A and the outer portion 16
- P' denotes the obtuse angle that is formed, in the central radial plane in each secondary valley 10B, between the inner portion 15B and the outer portion 16
- Q denotes the overall height of the bottom 3, i.e., the distance, measured axially, between the plane of the seat ring 14 and the junction between an outer portion 16 and the periphery 9
- R denotes the angular opening between the sides 11, measured in a transverse plane that is relatively far away from the dome 5, merged with the cutting plane VIII-VIII, as illustrated in FIG. 8
- S denotes the angular opening between the sides 11, measured in a transverse plane (i.e., perpendicular to the central radius of the foot 8) that is adjacent to the dome 5, merged with the cutting plane VII-VII, as illustrated in FIG. 7
- T denotes the overall radius, measured radially, of the dome 5
- U denotes the angular opening between the sides 11, measured in an adjacent transverse plane of the periphery, merged with the cutting plane X-X, as illustrated in FIG. 10
- V denotes the angular opening between the sides 11, measured in a transverse plane that is even farther away from the dome 5, merged with the cutting plane IX-IX, as illustrated in FIG. 9
- W denotes the radius of curvature, measured in a radial plane, of the central face 12 of the foot 8

The bottom 3 can be referred to as "petaloid bottom" because of its structure that is made of alternating protruding feet 8 and recessed valleys 10. However, its low height Q/diameter D ratio disqualifies it for the carbonated applications (typically for the fizzy beverages). This ratio is actually less than or equal to ¼.

A conventional petaloid bottom would have such a ratio of approximately ½. This bottom 3, which can be referred to as "mini-petaloid" because of its low height Q/diameter D ratio, is intended more for flat-liquid-type applications that are associated with the addition, immediately after the filling and before the stoppering, of a drop of liquid nitrogen whose evaporation puts the contents of the container 1 into overpressure, with this overpressure being less than or equal to 1.3 bar.

In this case, the height Q/diameter D ratio is advantageously between 0.15 and 0.25, and preferably on the order of 0.2.

According to an embodiment that is illustrated in FIG. 5, in the primary valleys 10A, the inner portion 15A is inclined, in relation to any plane that is parallel to the plane of the seat ring 14, toward the exterior of the container 1. This negative slope of the inner portion 15A, advantageously between 2° and 10°, is referred to as a "declivity."

According to an embodiment that is illustrated in FIG. 6, in the secondary valleys 10B, the inner portion 15B is, in contrast, inclined, in relation to any plane that is parallel to the plane of the seat ring 14, toward the interior of the container 1. This positive slope of the inner portion 15B, advantageously between 5° and 30°, is referred to as a "proclivity."

As a variant, moreover, the inner portion 15A of the primary valleys 10A could, like the inner portion 15B of the secondary valleys 10B, be inclined, in relation to any plane that is parallel to the plane of the seat ring 14, toward the interior of the container 1, i.e., as a proclivity, by an angle, moreover, that is less than or equal to 4°.

Thus, as is evident from the joint reading of FIG. 3, FIG. 5, and FIG. 6, the bottom 3 has, in the illustrated example, valleys 10A and 10B, whose inner portions 15A, 15B are alternately in declivity (FIG. 5) and in proclivity (FIG. 6). As we have already mentioned, the inner portions 15A of the primary valleys 10A open on the interior into the peripheral edge 7 of the central dome 5, while the inner portions 15B of the secondary valleys 10B open on the interior at a distance from the peripheral edge 7. This configuration increases the mechanical strength of the bottom 3 when it is under pressure.

More specifically, and as mentioned in the table above, the inner portions 15B of the secondary valleys 10B open onto the dome 5 at a distance F' from the peripheral edge 7 of the latter, between this peripheral edge 7 and the vertex 6 of the dome. According to the depth (i.e., the slope) of the inner portions 15B of the secondary valleys 10B, this distance F' is advantageously between 20% and 70% of the total height F of the dome 5:

$$0.2 \cdot F \leq F' \leq 0.7 \cdot F$$

In the illustrated example, the distance F' is approximately 60% of the total height F of the dome 5:

$$F' \cong 0.6 \cdot F$$

This configuration makes it possible to obtain a compromise between the structural rigidity of the bottom 3 in particular because of the depth of the inner portions 15B of the secondary valleys 10B, in particular in the vicinity of the center of the bottom 3, and the good blowability of the latter (i.e., its capacity to be shaped correctly during the blow molding of the container 1), in particular because of the relatively shallow depth of the inner portions 15A in the vicinity of the center of the bottom 3.

In addition, as also shown in FIG. 5 and FIG. 6, in at least one of the valleys 10 (and preferably in all of the valleys 10), the outer portion 16 is advantageously inclined, in relation to any plane that is parallel to the plane of the seat ring 14, toward the interior of the container 1, by an angle A. In other words, the outer portion 16 is in declivity. The angle A of inclination of the outer portion 16 is preferably between 20° and 30°.

The angles P and P' are obtuse; they are consequently strictly greater than 90° and strictly less than 180°.

More specifically, as illustrated in FIG. 5, the angle P is advantageously between 130° and 175°, and preferably approximately 160°.

As for the angle P', illustrated in FIG. 6, it is advantageously between 130° and 165°, and preferably from approximately 140° to 145°.

The width B of the seat ring 14 is advantageously between 0.4 mm and 1 mm, and preferably on the order of 0.5 mm.

The radius C of curvature is advantageously equal to approximately half the radius E.

The radius E is advantageously between 5 mm and 11 mm. In this case, the result is that the radius C is between 2.5 mm and 5 mm. The center of curvature of the radius E is located on the vertical of the seat ring 14.

As indicated previously, the seat ring 14 is connected to the body 2 by means of a structure that has a connecting fillet comprising two parts 8A and 8B. The radius E is that of the first part 8A, which is between the seat ring 14 and the junction 8C between the parts 8A and 8B of the connecting fillet. This radius is constant or can vary minutely.

The second part 8B of the fillet is between the junction 8C and the periphery 9 of the bottom 3 where the latter connects to the body 2. This second part 8B has an evolving radius of curvature between the junction 8C and the peripheral edge 9 of the bottom 3.

The overall diameter D of the bottom 3 is based on the capacity of the container 1. For a container 1 with a 0.5 l capacity, the diameter D can be approximately 65 mm (in this case, the radius E is advantageously approximately 6 mm). For a container 1 with a 1.5 l capacity, the diameter D can be approximately 90 mm (in this case, the radius E is advantageously approximately 9 mm).

The radius E' of the vertex is advantageously between 5 mm and 11 mm. It can be equal to the radius E. In practice, like the radius E, the radius E' is based on the capacity of the container 1. For a container 1 with a 0.5 l capacity, the radius E' can be approximately 6 mm. For a container 1 with a 1.5 l capacity, the radius E' can be approximately 9 mm.

The height F of the dome 5 is advantageously between 1 mm and 8 mm. In practice, this height F is based on the capacity of the container 1. For a container 1 with a 0.5 l capacity, the height F can be approximately 2 mm. For a container 1 with a 1.5 l capacity, the height can be approximately 7.5 mm. In this case, the distance F' is advantageously approximately 4.5 mm.

The angle G is advantageously between 20° and 40°. It is recalled that this is the angle in question in a radial plane, between the axis X of the body 2 and the tangent to the first part 8A of the connecting fillet, at the junction 8C between the parts 8A and 8B of this connecting fillet. In practice, the angle G is based on the capacity of the container 1 and, in particular, its diameter D. The value of the angle G, along the diameter D of the container and the radius E of curvature of the first part 8A of the fillet, determines the position of the junction 8C between the two parts 8A and 8B of the fillet for connecting the ring 14 to the body 2. For a container 1 with a 0.5 l capacity, the angle G can be approximately 25°. For a container 1 with a 1.5 l capacity, the angle G can be approximately 35°.

The distance H is advantageously linked to the overall diameter D of the bottom 3. More specifically, the distance H is preferably between 10% and 15% (and, for example, approximately 12%) of the diameter D.

The diameter J is advantageously between 65% and 75% (and, for example, approximately 70%) of the diameter D.

The distance L is advantageously between 50% and 85% (and, for example, approximately 70%) of the overall height Q of the bottom 3.

The distance M is advantageously based on the overall diameter D of the bottom 3. More specifically, the distance M is advantageously between 10% and 15% (and, for example, approximately 12%) of the diameter D.

The offset O can be zero, and, in this case, the vertex 17 is situated in line with the seat ring 14; it can also be positive (i.e., the vertex 17 is offset radially, in relation to the seat ring 14, toward the exterior of the container 1), or, in contrast, negative (i.e., the vertex 17 is offset radially, in relation to the seat ring 14, toward the interior of the container 1). In the two cases, the value of the offset O is small by comparison to the diameter D.

The offset O can be indexed on the radius E, for example in a ratio of 1 to 3, i.e., the ratio O/E is approximately ⅓.

Taking into account values already provided for E, it is understood that the offset O is between 1.5 mm and 3 mm.

In addition, the overall radius T of the dome 5 is advantageously between 5 mm and 15 mm. In practice, this radius T is based on the capacity of the container 1. For a container 1 with a 0.5 l capacity, the radius T is thus, for example, approximately 7 mm. For a container 1 with a 1.5 l capacity, the radius T is, for example, approximately 13 mm.

Finally, as can be noted in FIG. 7 to FIG. 10, the angular opening of the sides 11 is variable. More specifically, the angular opening of the sides 11 will decrease from the interior toward the exterior of the bottom 3 (i.e., from the axis X to the periphery 9), with the angular opening S being larger than the angular opening R, which is in turn larger than the angular opening V, itself larger than the angular opening U, which means that the sides 11 will be closing from the dome 5 toward the periphery 9.

This angular opening variation makes it possible to broaden the feet 8 toward the periphery 9, benefitting the stability of the container 1, and the strength of the feet 8, in particular during the palettization of the container 1.

Under the action of pressure in the container 1, the angle P has a tendency to deform by closing. Since the vertex 17 is in line with or very nearly in line with the seat ring 14, the sides 11, which at this location have their greater height (measured axially, merged with the distance M), absorb this deformation without in turn deforming too much, in such a way that the general deformation of the bottom 3 is slight, and so that it therefore readily withstands pressure. The concave shape of the central face 12 as well as the alternation of primary valleys 10A, relatively not very deep, and secondary valleys 10B, deeper, seem to contribute to this rigidity.

Tests conducted on the container 1 show that the most significant deformations are located on the dome 5, whose dome shape withstands pressure particularly well, while the zones that are peripheral to the dome 5 (valleys 10, feet 8) undergo only slight deformations.

The invention claimed is:

1. Container (1) made of plastic material comprising a body (2), which extends along a main axis (X), and a petaloid bottom (3), which extends the body (2), with this bottom (3) comprising:

A bottom wall (4) of general convex shape toward the exterior of the container (1), A central dome (5) formed recessed toward the interior of the container (1) and that extends from a central vertex (6) to a peripheral edge (7) by which the dome (5) connects to the bottom wall (4), and At least four feet (8) that form protrusions from the bottom wall (4) toward the exterior of the container (1), separated two by two by bottom wall (4) portions forming at least four recessed valleys (10) that extend radially from a central dome (5) of the bottom (3) to a periphery (9) of the latter, with each foot (8) having two sides (11), each bordering one of the at least four recessed valleys (10), and a central face (12) that, in a radial plane, has a curved profile with concavity facing the exterior of the container (1) and extends via an end face (13), with the end faces jointly forming a seat ring (14), with a planar cross-section, while being discontinuous at right angles with each valley (10), wherein:

Each valley (10) has an inner portion (15, 15A, 15B) that extends from the central dome (5) and an outer portion (16) that abuts the periphery (9) in the extension of the inner portion (15, 15A, 15B), with the inner portion (15, 15A, 15B) and the outer portion (16) being, in cross-section in a central radial plane in the valley (10), straight and forming together an obtuse angle (P) protruding toward the exterior of the container (1) and abutting a vertex (17) situated in line with or very nearly in line with the seat ring (14);

The bottom (3) comprises two groups of valleys (10) placed alternately:

Primary valleys (10A) whose inner portion (15A) connects to the dome (5) at the height of the peripheral edge (7) of the latter;

Secondary valleys (10B) whose inner portion (15B) connects to the dome (5) between the peripheral edge (7) and the central vertex (6) of the dome, at a distance (F') from the peripheral edge (7), the inner portion (15B) being inclined, in relation to any plane that is parallel to the plane of the seat ring (14), toward the interior of the container (1).

2. Container (1) according to claim 1, wherein the dome has a height (F), measured axially between its peripheral edge (7) and its vertex (6), and, in the secondary valleys (10B), the inner portion (15B) connects to the dome (5) at a distance (F') from the peripheral edge (7) that is encompassed between 20% and 70% of said height (F) of the dome.

3. Container (1) according to claim 1, wherein characterized in that the angle of inclination of the inner portion (15B) of the secondary valleys (10B) is between 5° and 30°.

4. Container (1) according to claim 1, wherein in the primary valleys (10A), the inner portion (15A) is inclined, in relation to any plane that is parallel to the plane of the seat ring (14), toward the exterior of the container (1).

5. Container (1) according to claim 4, wherein characterized in that the angle of inclination of the inner portion (15A) of the primary valleys (10A) is between 2° and 10°.

6. Container (1) according to claim 1, wherein in the primary valleys (10A), the inner portion (15A) is inclined, in relation to any plane that is parallel to the plane of the seat ring (14), toward the interior of the container (1) by an angle that is less than or equal to 4°.

7. Container (1) according to claim 1, wherein in the central radial plane in each valley (10), the vertex (17) of the primary and/or secondary valley (10) is offset in relation to the seat ring (14).

8. Container (1) according to claim 7, wherein the vertex (17) is offset in relation to the seat ring (14) by a value (O) of between 1.5 mm and 3 mm.

9. Container (1) according to claim 1, wherein the obtuse angle (P) that is formed, in the central radial plane with a primary valley (10A), between its inner portion (15A) and its outer portion (16), has a value of between 130° and 175°.

10. Container (1) according to claim 9, wherein the obtuse angle (P) that is formed, in the central radial plane with each primary valley (10A), between the inner portion (15) and the outer portion (16), has a value (P) of approximately 160°.

11. Container (1) according to claim 1, wherein the obtuse angle (P') that is formed, in the central radial plane with a secondary valley (10B), between its inner portion (15B) and its outer portion (16), has a value of between 130° and 165°.

12. Container (1) according to claim 1, wherein the obtuse angle (P') that is formed, in the central radial plane with a secondary valley (10B), between its inner portion (15B) and its outer portion (16), has a value of approximately 140° to 145°.

13. Container (1) according to claim 1, wherein with the bottom (3) of the container having an overall diameter (D), the vertex (17) of the valley (10) is distant from the plane of the seat ring (14) by a value (M) of between 10% and 15% of said diameter.

14. Container (1) according to claim 13, wherein the distance (M) from the vertex (17) of the valley (10) to the plane of the seat ring (14) is approximately 12% of the overall diameter (D) of the bottom (3).

15. Container (1) according to claim 1, wherein the bottom (3) has an overall diameter (D), all of the outer portions (16) abut the periphery (9) on the same junction plane, and the feet have a height (Q), measured axially between the plane of the seat ring (14) and said junction plane, whose value is between 15% and 25% of said diameter (D).

16. Container (1) according to claim 15, wherein the height (Q) of the feet (8) has a value of approximately 20% of the overall diameter (D) of the bottom (3).

17. The container according to claim 2, wherein in the primary valleys, the inner portion is inclined, in relation to any plane that is parallel to the plane of the seat ring, toward the exterior of the container.

* * * * *